US006860037B1

(12) United States Patent
Norek

(10) Patent No.: US 6,860,037 B1
(45) Date of Patent: Mar. 1, 2005

(54) DESERT BOOT OUTSOLE

(76) Inventor: Richard S. Norek, 8 Garrison Dr., Eliot, ME (US) 03903

( * ) Notice: Subject to any disclaimer, the term of this patent is extended or adjusted under 35 U.S.C. 154(b) by 22 days.

(21) Appl. No.: 10/605,748

(22) Filed: Oct. 23, 2003

(51) Int. Cl.[7] ..... A43B 5/04; A43B 23/28
(52) U.S. Cl. ..... 36/116; 36/59 C; D2/908
(58) Field of Search ..... 36/116, 25 R, 36/8.1, 59 C, 59 R, 113; D2/908, 947, 951, 953, 960

(56) References Cited

U.S. PATENT DOCUMENTS

| | | | | | |
|---|---|---|---|---|---|
| 1,387,988 | A | * | 8/1921 | Kaplan | 36/59 C |
| 2,124,986 | A | * | 7/1938 | Pipes | 36/59 C |
| 2,155,166 | A | * | 4/1939 | Kraft | 36/59 C |
| 3,082,584 | A | | 3/1963 | Hartman | 36/2.5 |
| 4,083,125 | A | * | 4/1978 | Benseler et al. | 36/32 R |
| 4,094,081 | A | * | 6/1978 | Reiner et al. | 36/116 |
| 4,096,649 | A | * | 6/1978 | Saurwein | 36/32 R |
| 4,447,969 | A | | 5/1984 | Johnson | 36/116 |
| 4,562,651 | A | * | 1/1986 | Frederick et al. | 36/102 |
| 4,566,209 | A | | 1/1986 | Johnson | 36/116 |
| 4,741,114 | A | * | 5/1988 | Stubblefield | 36/32 R |
| 5,203,097 | A | * | 4/1993 | Blair | 36/59 C |
| 5,367,792 | A | * | 11/1994 | Richard et al. | 36/114 |
| 6,470,599 | B1 | | 10/2002 | Chu | 36/113 |
| 2003/0037463 | A1 | | 2/2003 | Chu | 36/103 |

* cited by examiner

*Primary Examiner*—M. D. Patterson
(74) *Attorney, Agent, or Firm*—Phillip E. Decker

(57) ABSTRACT

A desert boot or shoe outsole for walking on sand having longitudinal ridges defining gaps between them, a continuous outer edge around the sole capable of containing sand while walking, and a sharp forward heel edge. Each ridge and gap has a cross sectional area, and each cross sectional area increases from a minimum at the outer edge to a maximum at the center of the outsole.

15 Claims, 1 Drawing Sheet

DESERT BOOT OUTSOLE

BACKGROUND OF INVENTION

1. Field of the Invention

The invention relates to shoes or boots having an outsole adapted for walking on sand.

2. Description of the Related Art

Exploration for oil, oil production, pipeline and electric grid service, and military deployment is increasingly occurring in desert regions, which requires personnel to walk confidently on sand. Existing work shoes and military boots are not well suited for this type of terrain. They cut easily through the sand surface, push the sand aside from under the sole with ease, and sink deeply prior to providing sufficient support and grip. A typical example is the desert boot specified by United States military specification MIL-B-4315M Type II. This boot features deeply grooved and slotted treads, peripheral openings in the tread, sharp outsole edges, and a generally convex outsole.

Although the sole provides good grip on semi-hard and hard soil or rocks, these features make it unsuitable for use in sand. For instance, the ridges cut easily into sand and the convex sole and wide grooves push the sand away from the boot. The result is that the wearer sinks into the sand. This wastes energy, thereby reducing on-foot mobility and increases the risk of heat related injuries in hot desert weather.

One solution is disclosed in U.S. Pat. No. 3,082,548 by Hartman, which is not admitted to being prior art by its mention in this Background section. Hartman discloses a strap-on sand shoe having compaction pockets that help prevent the user from sinking into sand. The soles of the strap-on shoes extend well beyond the soles of the wearer"s normal shoes, and bend in only one place. In addition, the ridges forming the compaction pockets are beveled inward, which tends to push sand out from under the shoe rather than trapping it underneath. Because the Hartman shoes are strap-on, they do not appear to be suitable for continuous duty by foot soldiers.

Another solution is disclosed in U.S. Pat. No. 4,094,081 by Reiner et al., which is not admitted to being prior art by its mention in this Background section. Reiner discloses a beach sandal having a cupped sole. The sole ridges containing the sand are beveled outward to better retain sand and support the user. However, it is also a strap-on shoe that appears cumbersome and is unsuitable for military use. Additionally, the Reiner sandal does not have a raised heel, which would be a disadvantage when using ladders or operating equipment.

Yet another solutions is disclosed in two patents by Johnson, U.S. Pat. Nos. 4,447,969, and 4,566,209, which are not admitted to being prior art by their mention in this Background section. The Johnson patents disclose add-on wings and webs to boots for walking on sand and loose material. The extra hardware expands with springs and hinges when the boots sink into sand. Presumably, the user would be as fleet of foot as the Roman god Mercury on his talaria. This is unlikely, especially in military applications, due to their sheer complexity and awkwardness.

What is needed, therefore, is a desert boot outsole for supporting the user in sand that does not require strap-on hardware and can be used on ladders and equipment.

SUMMARY OF INVENTION

A desert combat boot outsole for supporting the user in sand that does not require strap-on hardware and can be used on ladders and equipment has an outsole comprising longitudinal ridges defining gaps therebetween, a continuous outer edge around the sole adapted to contain sand while walking, and a sharp forward heel edge, wherein each ridge and gap has a cross sectional area, and each cross sectional area increases from a minimum at the outer edge to a maximum at the center of the outsole. These and other features, aspects, and advantages of the present invention will become better understood with regard to the following description, claims, and accompanying drawings.

DETAILED DESCRIPTION

The invention is a desert combat boot outsole for supporting the user in sand that does not require strap-on hardware and can be used on ladders and equipment. The outsole has longitudinal ridges defining gaps therebetween, a continuous outer edge around the sole adapted to contain sand while walking, and a sharp forward heel edge, wherein each ridge and gap has a cross sectional area, and each cross sectional area increases from a minimum at the outer edge to a maximum at the center of the outsole. The continuous outer edge is rounded on the outside to prevent easy cutting into the sand.

Figure 1:
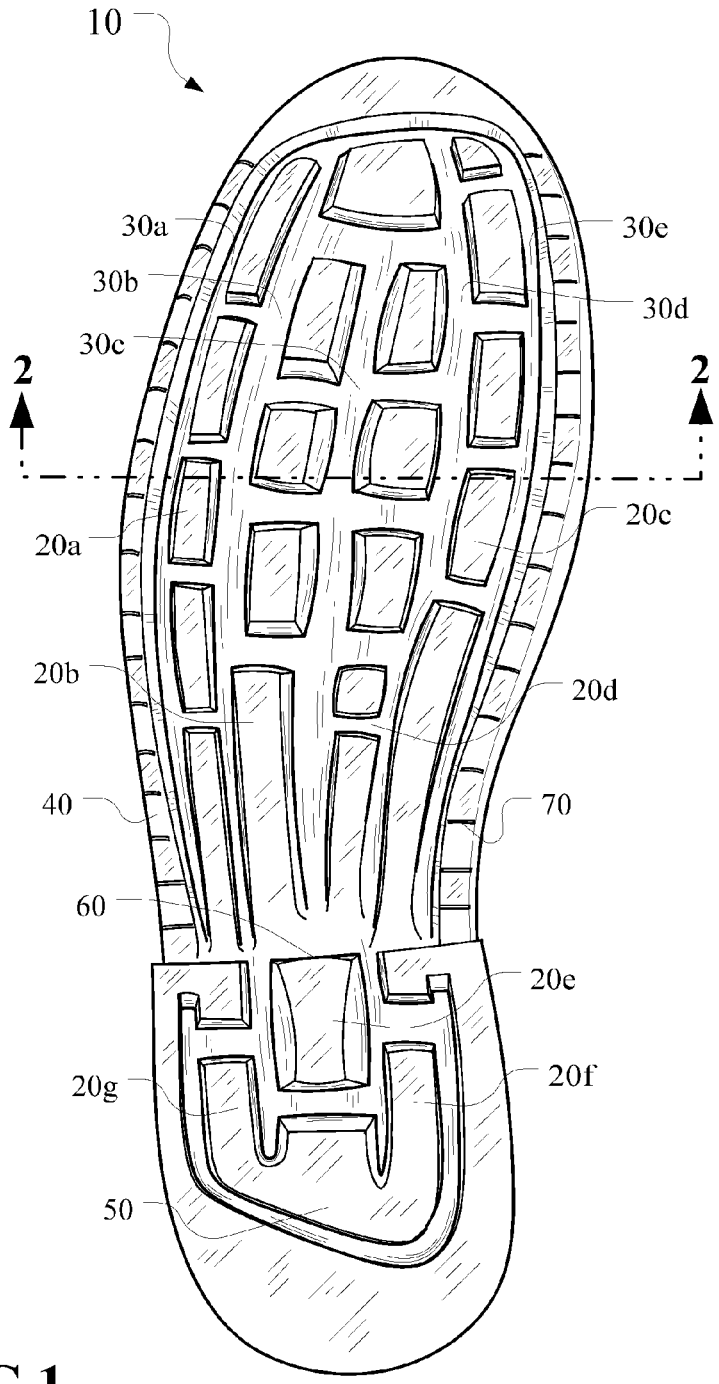
FIG. 1 is a plan view of the bottom of the sole of the present invention, looking up from the ground.

Turning to FIG. 1, the outsole 10 has a rounded, continuous outer edge. The outer edge 40 may also have a series of cuts 70 perpendicular to the direction of shoe travel that facilitate foot flexing. The tips of the cuts may be rounded to discourage crack initiation.

The sole 10 also has a plurality of longitudinal ridges 20*a*, 20*b*, 20*c*, 20*d*, 20*e*, 20*f*, 20*g*. This longitudinal tread pattern prevents digging in while walking or sliding. Sand can move along the tread, but not sideways. Although four ridges are shown, a different number could be used.

The outsole 10 has a raised heel 50 terminating in a sharp forward heel edge 60. The heel 50 and edge 60 facilitate using ladders and operating equipment and machinery. Because of this feature, the outsole 10 is also suitable for general use in military applications, and not only for walking on sand. The outsole can also be used by workers drilling or servicing wells or pipelines in the sand. Some applications may allow shoes that do not have a distinct heel. This would allow the outer edge 40 to be continuous all around the outsole.

Figure 2:
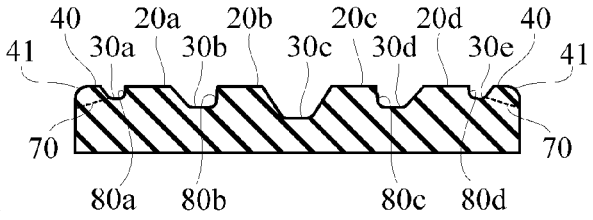
FIG. 2 is a cross section of the sole of FIG. 1.

FIG. 2 is a cross section view of the sole 10. The outer ridge 40 and the longitudinal ridges 20*a*, 20*b*, 20*c*, 20*d*, 20*e*, 20*f*, 20*g* define gaps 30*a*, 30*b*, 30*c*, 30*d*, 30*e* between them. Several features of the gaps 30 and ridges 20 are noteworthy. First is the depth of the gaps. Gaps 30*a*, 30*e* closest to the outside of the sole 10 are the shallowest. Preferably they are about 0.10 inches deep. Then, the gaps 30*b*, 30*d* that are the next closest to the edge are deeper than the gaps 30*a*, 30*e* closer to the edge. Preferably, these gaps 30*b*, 30*d* are about 0.20 inches deep. The gap 30*c* closest to the center of the sole 10 will be the deepest. Preferably the center gap 30*c* is about 0.30 inches deep. The benefit of having gaps with depths according to this distribution is that the gaps approximate a concave surface, which is ideal for walking on sand.

The second noteworthy feature is that the side of each longitudinal ridge 20*a*, 20*b*, 20*c*, 20*d*, 20*e*, 20*f*, 20*g* that is closest to the longitudinal centerline of the sole has a beveled edge. The angle of the bevel is between 15 and 75 degrees, but is preferably about 45 degrees. This feature directs and retains loose sand at the surface toward the center of the sole 10. The other side of the ridges 80*a*, 80*b*, 80*c*, 80*d* are only slightly beveled to accommodate self-cleaning. The bevel is between about two and about five degrees.

Both of these features serve to provide a generally concave sole while at the same time retaining a continuous height of the ridges 40, 20*a*, 20*b*, 20*c*, 20*d*. Another way of describing these features is that each ridge and gap define a cross sectional area. The cross sectional area must be smallest near the edge of the sole and increase until it is greatest at the center of the sole.

Not only does the sole 10 retain sand underneath, but it makes the sole suitable for general use on flat surfaces like those found on roads or vehicles. The heel 50 having the sharp forward edge 60 facilitates use on ladders and equipment. The sole 10 is designed to be affixed to the bottom of a shoe or boot to form a unitary article of footwear that is suitable for desert service.

While there have been described what are at present considered to be the preferred embodiments of this invention, it will be obvious to those skilled in the art that various changes and modifications may be made therein without departing from the invention, and it is, therefore, aimed to cover all such changes and modifications as fall within the true spirit and scope of the invention.

What is claimed:

1. An outsole for walking on sand comprising longitudinal ridges defining gaps therebetween, a continuous outer edge around the sole adapted to contain sand while walking, and a sharp forward heel edge, wherein each ridge and gap has a cross sectional area, and each cross sectional area increases from a minimum at the outer edge to a maximum at the center of the outsole and wherein each longitudinal ridge has a side closest to the longitudinal centerline of the sole, and a side opposite the closest side, the side closest to the longitudinal centerline being beveled between 15 and 75 degrees.

2. The outsole of claim 1, wherein the continuous outer ridge has cuts perpendicular to the direction of shoe travel in the material to facilitate bending.

3. The outsole of claim 1, the side closest to the longitudinal centerline being beveled about 45 degrees.

4. The outsole of claim 1, the side opposite the closest side being beveled between two and five degrees.

5. An outsole for walking on sand comprising longitudinal ridges defining gaps therebetween, a continuous outer edge around the sole adapted to contain sand while walking, and a sharp forward heel edge, wherein the ridges and outer edge are aligned to form a substantially flat walking surface, and the bottoms of the gaps, taken by themselves, approximate a concave shape.

6. The outsole of claim 5 wherein the gaps closest to the outside edge of the sole are about 0.10 inches deep.

7. The outsole of claim 6 wherein the gaps that are the next closest to the outside edge are about 0.20 inches deep.

8. The outsole of claim 7 wherein the gaps that are the closest to the longitudinal centerline are about 0.30 inches deep.

9. An outsole for walking on sand comprising longitudinal ridges defining gaps therebetween, a continuous outer edge around the sole adapted to contain sand while walking, and a sharp forward heel edge, wherein the ridges and outer edge are aligned to form a substantially flat walking surface, and the gaps nearest the outside edge of the sole are the shallowest gaps, and the gaps nearest the longitudinal centerline are the deepest gaps to approximate a substantially concave surface.

10. An outsole for walking on sand comprising longitudinal ridges defining gaps therebetween, and a continuous outer edge around the sole adapted to contain sand while walking, wherein each ridge and gap has a cross sectional area, and each cross sectional area increases from a minimum at the outer edge to a maximum at the center of the outsole and wherein each longitudinal ridge has a side closest to the longitudinal centerline of the sole, and a side opposite the closest side, the side closest to the longitudinal centerline being beveled between 15 and 75 degrees.

11. The outsole of claim 10, wherein the continuous outer ridge has cuts perpendicular to the direction of shoe travel in the material to facilitate bending.

12. The outsole of claim 10, the side closest to the longitudinal centerline being beveled about 45 degrees.

13. The outsole of claim 10, the side opposite the closest side being beveled between two and five degrees.

14. An outsole for walking on sand comprising longitudinal ridges defining gaps therebetween, and a continuous outer edge around the sole adapted to contain sand while walking, wherein the ridges and outer edge are aligned to form a substantially flat walking surface, and the bottoms of the gaps, taken by themselves, approximate a concave shape.

15. The outsole of claim 14 wherein the gaps closest to the outside edge of the sole are about 0.10 inches deep.

* * * * *